US010660373B2

(12) United States Patent
Martin

(10) Patent No.: US 10,660,373 B2
(45) Date of Patent: May 26, 2020

(54) UNDERGARMENT HAVING ELASTIC GUSSETS

(71) Applicant: Terri Martin, West Orange, NJ (US)

(72) Inventor: Terri Martin, West Orange, NJ (US)

( * ) Notice: Subject to any disclaimer, the term of this patent is extended or adjusted under 35 U.S.C. 154(b) by 51 days.

(21) Appl. No.: 16/150,306

(22) Filed: Oct. 3, 2018

(65) Prior Publication Data

US 2020/0107587 A1 Apr. 9, 2020

(51) Int. Cl.

| | |
|---|---|
| ***A41D 27/24*** | (2006.01) |
| ***A41B 9/00*** | (2006.01) |
| ***A41B 17/00*** | (2006.01) |
| *A41D 27/00* | (2006.01) |

(52) U.S. Cl.

CPC ..... *A41B 9/001* (2013.01); *A41B 17/00* (2013.01); *A41B 2300/22* (2013.01); *A41B 2500/50* (2013.01)

(58) Field of Classification Search

CPC ..... A41B 9/04; A41B 11/14; A41B 200/38; A41B 9/02; A41B 9/12; A41B 9/001; A41B 1/08; A41B 2300/35; A41B 9/00; A41B 2300/20; A41B 2400/20; A41B 2500/20; A41D 1/08; A41D 2400/38; A41D 13/0543; A41D 7/005; A41D 13/0015; A41D 1/00; A41D 1/089; A41D 2300/22; A41D 2300/24; A41D 2300/50; A41D 2400/44; A41D 27/02; A41D 27/24; A41D 13/1254; A41D 17/02; A41D 27/00; A41D 27/202; D04B 1/108; A41F 9/00; A41F 9/02

See application file for complete search history.

(56) References Cited

U.S. PATENT DOCUMENTS

| | | | | | |
|---|---|---|---|---|---|
| 1,785,286 | A * | 12/1930 | Robischon | A41B 9/08 | 2/78.2 |
| 1,910,715 | A * | 5/1933 | Ryden | A41B 9/02 | 2/402 |
| 2,255,931 | A * | 9/1941 | Kloster | A41B 9/02 | 2/404 |
| 2,651,048 | A * | 9/1953 | Milberg | A41B 9/04 | 2/406 |
| 2,838,761 | A * | 6/1958 | Title | A41B 9/04 | 2/406 |
| 3,694,816 | A * | 10/1972 | Smith | A41B 11/14 | 2/409 |
| 4,041,736 | A * | 8/1977 | Fregeolle | A41B 11/14 | 66/177 |
| 4,106,514 | A * | 8/1978 | Lowth | A41B 11/14 | 2/240 |
| 4,468,815 | A * | 9/1984 | Pellegri | A42B 1/22 | 2/171.01 |
| 4,630,320 | A * | 12/1986 | Van Gompel | A41B 9/001 | 2/183 |

(Continued)

*Primary Examiner* — Robert H Muromoto, Jr.
(74) *Attorney, Agent, or Firm* — Kristen A. Grant; Grant Attorneys At Law PLLC

(57) ABSTRACT

An undergarment which has a body, a left gusset on a left side of the body wherein the left gusset is a triangle with a vertical length no more than half of the vertical length of the left side of the body, and a right gusset on a right side of the body wherein the right gusset is a triangle with a vertical length no more than half of the vertical length of the right side of the body, the left and right gussets fixedly flush with the body of the undergarment.

4 Claims, 3 Drawing Sheets

(56) References Cited

U.S. PATENT DOCUMENTS 5,819,323 A * 10/1998 Edenfield ..... A41B 9/02 2/466
6,877,300 B1 * 4/2005 Hathcock ..... A01K 13/008 54/79.2
7,231,754 B2 * 6/2007 Hathcock ..... A01K 13/008 54/79.2
7,669,248 B2 * 3/2010 Toratani ..... A41B 9/004 2/109
7,793,619 B2 * 9/2010 Kajanoff ..... A01K 27/002 119/850
9,713,351 B2 * 7/2017 Wexler ..... A41B 9/004
9,901,124 B2 * 2/2018 James ..... A41B 9/04
10,433,595 B2 * 10/2019 Bell ..... A41D 13/0543
2003/0196252 A1 * 10/2003 Blakely ..... A41B 11/005 2/400
2005/0176324 A1 * 8/2005 Michel ..... A41B 9/00 442/304
2010/0170026 A1 * 7/2010 Jeffords ..... A41D 1/06 2/227
2010/0281601 A1 * 11/2010 Clarke ..... A41D 1/08 2/236
2011/0067159 A1 * 3/2011 Smith ..... A41D 1/08 2/22
2013/0042394 A1 * 2/2013 Wexler ..... A41B 9/004 2/400
2013/0067640 A1 * 3/2013 Hefter ..... A41D 1/06 2/234
2013/0125293 A1 * 5/2013 Stearns ..... A41D 1/06 2/227
2014/0025027 A1 * 1/2014 Png ..... A61F 13/49006 604/371
2016/0007662 A1 * 1/2016 Powell ..... A41D 1/002 2/228
2017/0027246 A1 * 2/2017 Inzer ..... A41D 1/08
2017/0172237 A1 * 6/2017 Martin ..... A41D 27/10
2017/0238620 A1 * 8/2017 Wexler ..... A41B 9/004
2018/0020746 A1 * 1/2018 Wyner ..... A41D 1/088 2/237
2018/0084837 A1 * 3/2018 Ng ..... A41B 9/023
2018/0146717 A1 * 5/2018 Ballone ..... A41D 27/10
2018/0263299 A1 * 9/2018 Padin ..... D04B 1/06
2018/0318142 A1 * 11/2018 Gagliardo ..... A41F 9/00
2019/0082745 A1 * 3/2019 Berkowitz ..... A41B 9/02
2019/0125003 A1 * 5/2019 Hanson Allen ..... A41B 9/04
2019/0223520 A1 * 7/2019 Padin ..... A41B 9/04
2019/0320727 A1 * 10/2019 Bain ..... A61F 13/70

* cited by examiner

UNDERGARMENT HAVING ELASTIC GUSSETS

BACKGROUND

Field of the Invention

The present invention is directed generally to undergarments, and more particularly to a women's undergarment with elastic gussets specifically placed for increased comfort.

Related Art

For years women have been concerned with finding attractive undergarments which provide adequate comfort. The lingerie and shapewear industries have grown significantly in the past decade providing women with a variety of options. A popular style which has emerged is the boy short panty. This is a style of women's underwear that is named for its similarity in looks to men's knit boxer briefs, which themselves are a variation of traditional boxer shorts. A popular problem that many women face is that many boy short panties provide too much tension around the leg opening areas causing discomfort and sometimes decreased circulation.

Currently, there are a number of techniques which attempt to solve this problem however many of these techniques have their disadvantages. For example, the use of elastic trim around the circumference of the leg opening can cause tension for many wearers, hem-less undergarments and 100% cotton styles become stretched out over a period of time, and full elastic lace undergarments can cause chaffing and be uncomfortable to wear during high intensity activities.

The cheeky boy short panty is a style of boy short which is slightly shorter than the standard boy short panty revealing the lower portion of the wearer's buttocks. While the cheeky panty resolves the issue of tension around the leg by having shorter leg openings, this style is not adequate for the wearer who opts for a boy short style for the benefit of the full coverage.

The present invention discloses an improved boy short panty providing its wearer with full coverage and minimal tension around the leg opening area, which may also be suitable for the active wearer.

SUMMARY OF THE INVENTION

It is to be understood that the phraseology and terminology employed herein are for the purpose of the description and should not be regarded as limiting.

In view of the foregoing disadvantages in the known styles of boy short panties, the present invention presents an improved non-restrictive women's undergarment comprising of a body, a left leg opening, a right leg opening, a left gusset on the left side of the body, and right gusset on the right side of the body. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
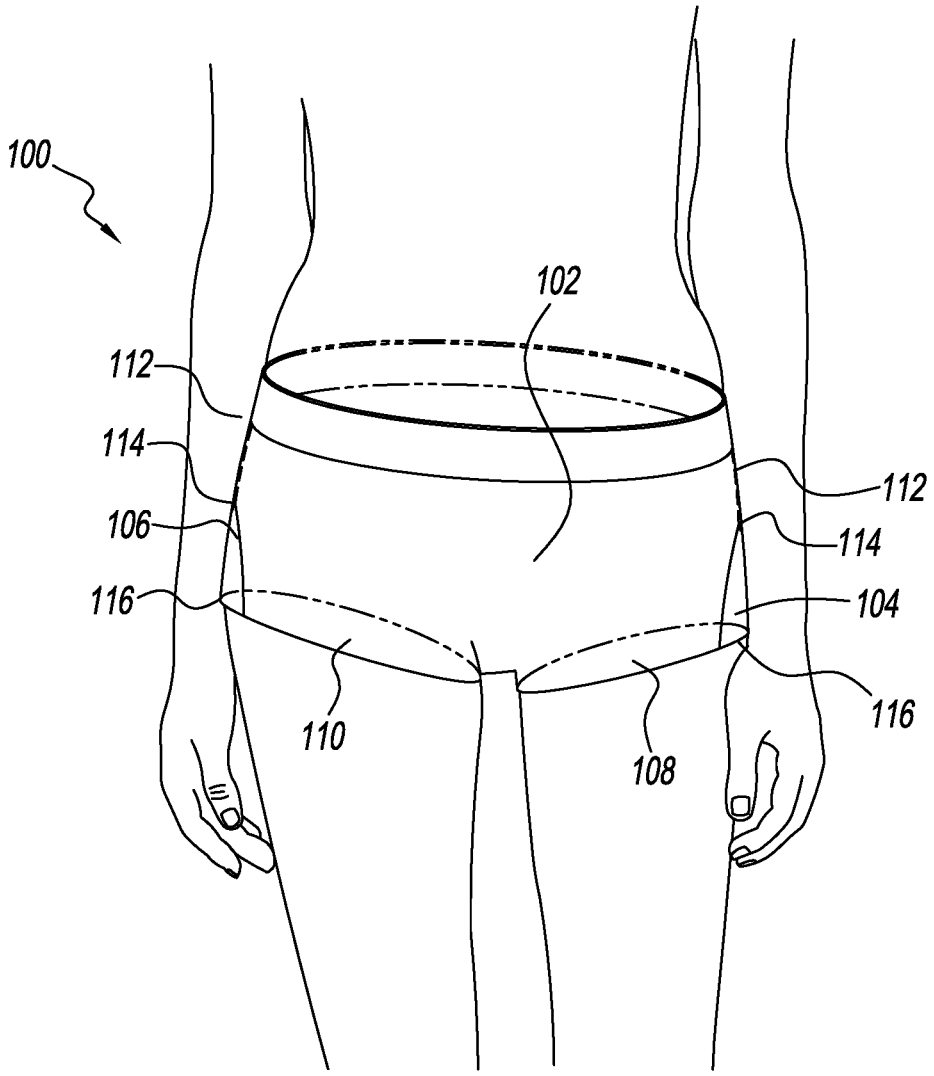
FIG. 1 is a perspective view of a women's boy short undergarment according to an embodiment of the present invention.
Figure 2:
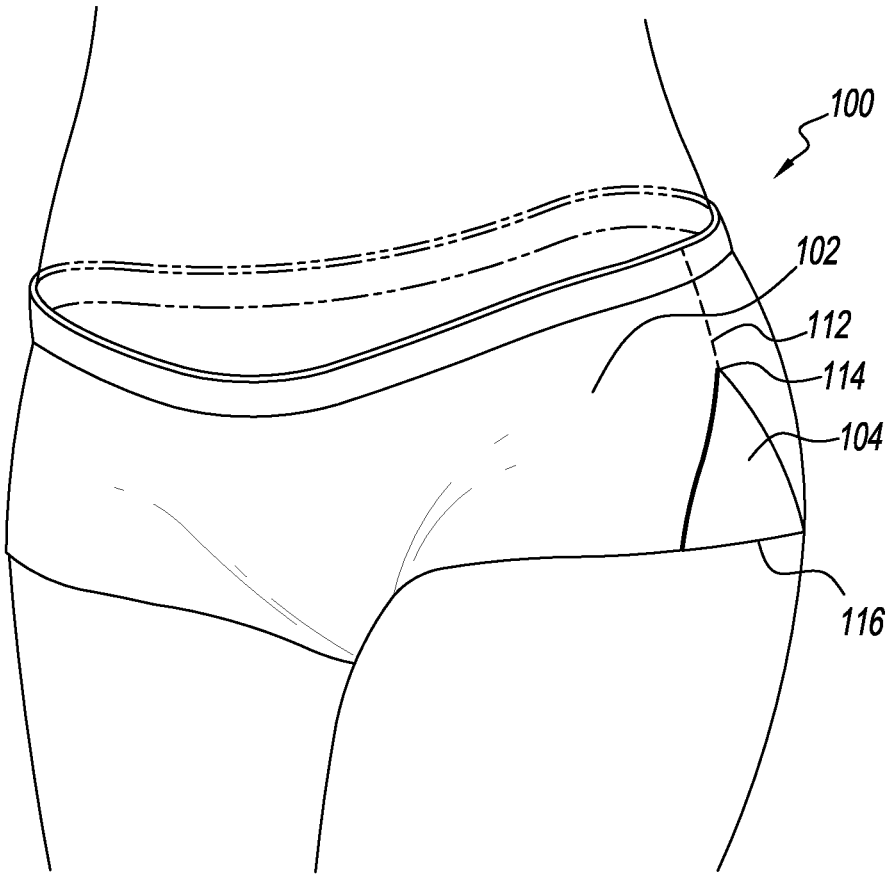
FIG. 2 is a perspective view of a women's boy short undergarment according to an embodiment of the present invention.
Figure 3:
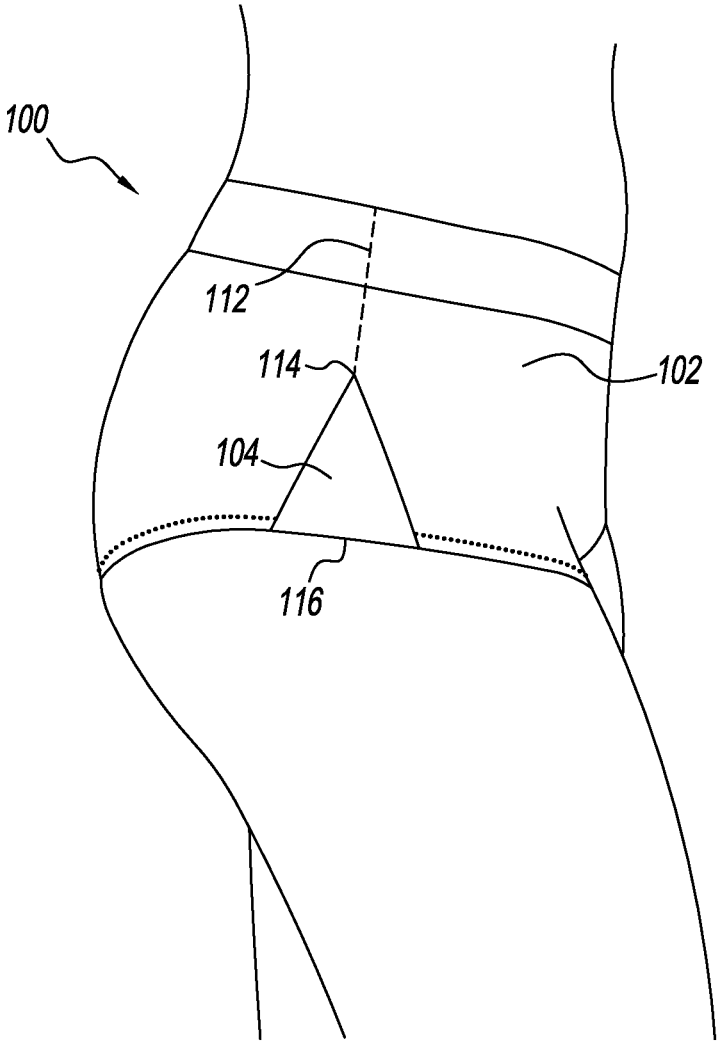
FIG. 3 is a side view of a women's boy short undergarment according to an embodiment of the present invention.

Referring now to the figures, where similar reference characters denote similar elements throughout, FIG. 1 shows a perspective view of a women's boy short undergarment 100 according to an embodiment of the present invention, the undergarment 100 comprising of a body 102, a left leg opening 108, a right leg opening 110, a left gusset 104 on the left side of the body, and right gusset 106 on the right side of the body. The left gusset and right gusset are triangles each comprising of a tip 114 and a base 116. The gussets may be equilateral triangles or isosceles triangles. The left and the right sides of the body each comprising of a side seam 112 beginning at the waist of the body and ending at the tips 114 of the gussets. The side seams do not continue through the gussets. In a preferred embodiment of the present invention the vertical length of each gusset 104, 106 spans no more than ½ of the length of its respective side of the undergarment. The undergarment may be in a standard boy short style, hipster style or high waist style.

All measurements hereinafter described are in relation to a sample size medium, in conformation with the standard measurements for a size medium panty as is typically known in the art. Measurements may be graded up and down in accordance with standard grading techniques typically known in the art.

The left and right sides of the body, measured from the waist of the body to the respective leg opening, are each at least 4 inches long. The bases of the gussets 116 are in line with the leg openings and measure approximately 2 to 3 inches. The gussets 104, 106 may range from 2-3 inches measured vertically.

The body 102 of the undergarment is made of a fabric or fabric blend comprising anywhere from 5% to 30% elastane. By way of example only, the body 102 of the undergarment may comprise of nylon spandex, polyester spandex, rayon spandex, cotton spandex jersey or similar fabric or fabric blend typically known in the art. The gussets 104, 106 are made of a fabric or fabric blend comprising anywhere from 5%-10% elastane. By way of example only, the gussets may comprise of elastic lace, elastic mesh, or the like.

What is claimed is:

1. An undergarment comprising:

a. a body, a left gusset, and a right gusset;

b. the body comprising a waist opening at the top of the body, a left leg opening at the bottom left of the body, a right leg opening at the bottom right of the body, and a crotch portion in between the left leg opening and the right leg opening;

c. the left gusset on a portion of the left side of the body wherein the left gusset is a flat triangle with a vertical length no more than half of the vertical length of the left side of the body, the left gusset having a tip, a base, and a gusset interior, the tip parallel to the base, the base flush with the left leg opening, and the gusset interior fixedly flush with the body of the undergarment; and d. the right gusset on a portion of the right side of the body wherein the right gusset is a flat triangle with a vertical length no more than half of the vertical length of the right side of the body, the right gusset having a tip, and a base, and a gusset interior, the tip parallel to the base, the base flush with the right leg opening, and the gusset interior fixedly flush with the body of the undergarment; and e. the body further comprising a seam on a portion of each of the left side and the right side of the body said respective portion of the left side and right side of the body absent of gussets, wherein the seam on the left side of the body is parallel to the seam on the right side of the body, each seam starting at the waist opening of the body and ending at the tip of the respective gusset.

2. The undergarment of claim 1, wherein the body comprises of a fabric blend comprising of 5% to 30% elastane, inclusive.

3. The undergarment of claim 1, wherein the left gusset and the right gusset comprise of a fabric blend comprising 5% to 10% elastane, inclusive.

4. The undergarment of claim 1, wherein the horizontal length of each of the left gusset and the right gusset is between 2 and 3 inches, inclusive.

* * * * *